US010099444B2

(12) United States Patent
D'Anglade

(10) Patent No.: US 10,099,444 B2
(45) Date of Patent: Oct. 16, 2018

(54) PAPERBOARD CORNER, AND METHOD OF MANUFACTURING THE SAME

(71) Applicant: ABZAC CANADA INC., Drummondville, Quebec (CA)

(72) Inventor: Pierre-Michel D'Anglade, Ville Mont-Royal (CA)

(73) Assignee: Abzac Canada Inc., Drummondville, Quebec (CA)

( * ) Notice: Subject to any disclaimer, the term of this patent is extended or adjusted under 35 U.S.C. 154(b) by 0 days.

(21) Appl. No.: 15/675,348

(22) Filed: Aug. 11, 2017

(65) Prior Publication Data

US 2017/0341333 A1 Nov. 30, 2017

Related U.S. Application Data

(63) Continuation of application No. 14/110,825, filed as application No. PCT/CA2012/050347 on May 28, 2012, now Pat. No. 9,764,527.

(Continued)

(51) Int. Cl.
*B31D 3/00* (2017.01)
*B65D 81/05* (2006.01)

(Continued)

(52) U.S. Cl.
CPC ..... *B31D 3/04* (2013.01); *B31B 50/624* (2017.08); *B31C 13/00* (2013.01); *B31D 5/006* (2013.01);

(Continued)

(58) Field of Classification Search
CPC . B31D 3/00; B31D 3/002; B31D 3/04; B65D 81/02; B65D 81/113; B65D 81/053; B65D 81/054

(Continued)

(56) References Cited

U.S. PATENT DOCUMENTS 3,072,313 A 1/1963 Svendsen
3,129,868 A 4/1964 Jenk (Continued)

FOREIGN PATENT DOCUMENTS

CA 2738558 A1 1/2012
JP 6-115567 A 4/1994

(Continued)

OTHER PUBLICATIONS

Notification of Transmittal of the International Search Report and the Written Opinion of the International Searching Authority, or the Declaration corresponding to International Application No. PCT/CA2012/050347 dated Jun. 26, 2012.

(Continued)

*Primary Examiner* — Hilary L Gutman
(74) *Attorney, Agent, or Firm* — Myers Bigel, P.A.

(57) ABSTRACT

The invention concerns an elongated protective corner for the transport and/or packaging of products. The corner has at least two non-corrugated paperboard plies combined together to create two perpendicular wings and an apex The plies form multiple ply sections, and at least one of the ply sections of a given ply overlaps another ply section of the same ply. This overlapping arrangement gives the apex a resistance force of about 100 to about 500 lbs. The thickness of the corner can vary, with each wing being in the range of about 100 to about 250 points, and each ply is made from paperboard having a grammage of about 120 to about 380 g/m$^2$. The resistance force can be determined by mounting the corner upon two blocks, and applying a force to the apex at a middle of the corner until a fracture is detected.

20 Claims, 14 Drawing Sheets

Related U.S. Application Data

(60) Provisional application No. 61/490,884, filed on May 27, 2011.

(51) Int. Cl.

| | |
|---|---|
| ***B31D 3/04*** | (2006.01) |
| ***B65D 71/04*** | (2006.01) |
| ***B31B 50/62*** | (2017.01) |
| ***B31D 5/00*** | (2017.01) |
| ***B31C 99/00*** | (2009.01) |
| ***B31D 5/04*** | (2017.01) |

(52) U.S. Cl.
CPC ..... *B31D 5/04* (2013.01); *B65D 71/04* (2013.01); *B65D 81/054* (2013.01)

(58) Field of Classification Search
USPC ..... 206/15, 68, 453, 521–524, 583–594; 216/56; 493/374
See application file for complete search history.

(56) References Cited

U.S. PATENT DOCUMENTS

| | | | |
|---|---|---|---|
| 3,511,464 | A | 5/1970 | Doll |
| 3,672,952 | A | 6/1972 | Brown et al. |
| 3,725,170 | A | 4/1973 | Doll |
| 3,734,389 | A | 5/1973 | Brown |
| 3,879,253 | A | 4/1975 | Doll |
| 4,399,915 | A | 8/1983 | Sorenson |
| 4,771,893 | A | 9/1988 | Liebel |
| 5,181,611 | A | 1/1993 | Liebel |
| 5,613,335 | A | 3/1997 | Rennich |
| 5,813,537 | A | 9/1998 | DeReu et al. |
| 6,527,119 | B1 | 3/2003 | Markert et al. |
| 6,881,469 | B2 | 4/2005 | Hightower |
| 6,915,603 | B2 | 7/2005 | Hunt |
| 7,299,924 | B2 | 11/2007 | Robinson, Jr. |
| 7,383,952 | B2 | 6/2008 | Kruelle et al. |
| 8,443,975 | B2 | 5/2013 | Butch, Jr. et al. |
| 2001/0001446 | A1 | 5/2001 | Moreyra |
| 2002/0189969 | A1 | 12/2002 | Renck |
| 2003/0111383 | A1 | 6/2003 | Qiu et al. |
| 2004/0255537 | A1 | 12/2004 | Dagleish et al. |
| 2005/0082200 | A1 | 4/2005 | Robinson, Jr. |
| 2005/0087663 | A1 | 4/2005 | Schroeder |
| 2005/0121356 | A1 | 6/2005 | Wisecarver |
| 2005/0121357 | A1 | 6/2005 | Robinson, Jr. |
| 2012/0000815 | A1 | 1/2012 | Butch, Jr. et al. |
| 2014/0050897 | A1 | 2/2014 | Rometty et al. |

FOREIGN PATENT DOCUMENTS

| | | | |
|---|---|---|---|
| JP | 5229574 | B2 | 11/2010 |
| TW | M 297 354 | U | 9/2006 |
| WO | 2012/003054 | A1 | 1/2012 |
| WO | WO 2015/140640 | A2 | 9/2015 |

OTHER PUBLICATIONS

Extended European Search Report, EP Application No. 12792399.3, Jan. 21, 2015, 7 pages.

Notification of Transmittal of the International Search Report and the Written Opinion of the International Searching Authority, or the Declaration corresponding to International Application No. PCT/CA2016/050153 dated May 18, 2016.

PAPERBOARD CORNER, AND METHOD OF MANUFACTURING THE SAME

RELATED APPLICATIONS

This application is a continuation application of and claims priority to U.S. application Ser. No. 14/110,825, filed on Nov. 13, 2013, which is a 35 U.S.C. § 371 national stage application of PCT Application No. PCT/CA2012/050347, filed on May 28, 2012, which claims priority from U.S. Provisional Application No. 61/490,884 filed on May 27, 2011. The contents of each of these applications are incorporated herein by reference in their entireties. The above-referenced PCT International Application was published as International Publication No. WO 2012/162827 A1 on Dec. 6, 2012.

FIELD OF THE INVENTION

The present invention relates to protective devices to protect products from impacts, for example when stored or transported. More particularly, in its intended preferred use, the present invention relates to an improved paperboard corner to be mounted against merchandise so as to protect the merchandise during packaging and moving.

BACKGROUND OF THE INVENTION

Known in the art are various paperboard forms or corners for protecting merchandise. The forms are usually mounted or fitted onto the corners or edges of a product before the product is loaded into a packaging box, or shipped from one destination to another.

In general, paperboard forms are constructed from multiple plies of a paper product such as corrugated cardboard or other paper products known in the art. A "ply" of paperboard can be a single paperboard sheet, or can be composed of many paperboard layers laminated or adhered together so as to form the ply. In order to make the known paperboard forms, multiple plies are laid one atop the other, and each ply is attached to another by an adhesive such as glue. Other adhesives can include polyvinyl alcohol, polyvinyl acetate, dextrin, and acrylic. Each ply can have a thickness in the range of 15-45 points, depending on the merchandise to be protected. The term "point" is used in the art to measure thickness, and 10 points are equivalent to 0.010 in. or 0.25 mm. Once laid atop one another and glued, the plies are folded into the desired shape, typically a corner with a 90° bend. Each ply can be coated with a chemical substance so as to provide a certain degree of structural rigidity and water resistance.

One example of a known paperboard corner is described in US patent application US 2005/0087663 A1 by Schroeder, which was published on Apr. 28, 2005. This document describes an elongated edge protector for protecting an edge or corner of an article. The edge protector is made up of a plurality of paperboard plies laminated together and formed into a rigid substantially right angled member. A layer of plastic laminate is adhered to the outside faces of the legs.

Another example of a known corner is U.S. Pat. No. 7,299,924 B2 to Robinson, which was granted on Nov. 27, 2007. This document describes an edge protector made of a blank sheet of foldable material, such as corrugated paperboard. The sheet has a plurality of laterally spaced parallel fold lines dividing the sheet into consecutive panels to allow for folding of the panels into overlapping engagement. First and second legs are formed from the overlapping panels.

The following documents also relate to paperboard products or forms: U.S. Pat. No. 6,527,119; U.S. Pat. No. 5,813,537; U.S. Pat. No. 4,771,893; U.S. Pat. No. 4,399,915; US 2012/0000815; and JP 5229574 A.

Also known in the art are the substantial drawbacks associated with such conventional paperboard forms. The type of paper used for some types of conventional corners is generally thick and dense, such as corrugated paperboard, and the cost of such paper contributes to the relatively high production costs for such corners, and especially for thicker corner forms. For applications in which the corners are to be strapped, the paperboard is selected mainly as a function of its cost and therefore may not provide the desired rigidity and resistance to tearing that is desired when transporting, packaging, or strapping certain merchandise. The only known way to increase the resistance of conventional protective forms is to use thicker types of paperboard or to add additional plies. It would be thus be desirable to be able to manufacture a paperboard protective corner which would be as resistant or more resistant than conventional cardboard corners, while being less expensive and if possible, thinner than conventional cardboard forms. Furthermore, the material making up conventional corners is often selected based solely on cost, and there is therefore a wide variance in the type and quality of material used. With such corners, even if they are of the same thickness and have the same dimensions, their physical characteristics (resistance to strapping, tearing, etc.) can vary greatly.

Hence, in light of the aforementioned, there is a need for an improved paperboard corner, which by virtue of its design and components, would be able to overcome or at least minimize some of the aforementioned prior art problems.

SUMMARY OF THE INVENTION

The object of the present invention is to provide a paperboard corner, which by virtue of its design and components, satisfies some of the above-mentioned needs and is thus an improvement over other related devices and/or methods known in the art.

In accordance with the present invention, the above object is achieved, as will be easily understood, with a paperboard corner for protecting a portion of a product during transport or packaging. The corner is made from plies of non-corrugated paperboard products which are folded in such a way as to provide a larger resistance force for a given thickness, when compared to known corners.

More particularly, and according to an aspect of the invention, there is provided an elongated protective corner for applying against a portion of a product during transport or packaging so as to protect the portion of the product, the corner comprising:

at least two non-corrugated paperboard plies combined together, each ply folded into a plurality of ply sections so as to create first and second wings intersecting substantially perpendicularly at an apex, each ply being configured so that at least one of its ply sections overlaps at least partially another of its ply sections;

the first and second wings having a thickness in the range of about 100 to about 250 points;

each ply being made from a paperboard having a grammage of about 120 g/m2 to about 380 g/m$^2$; and the apex being configured to have a resistance force of about 100 to about 500 lbs, the resistance force being obtainable by mounting the corner upon two blocks, both blocks being about 1.5 inches wide and separated by about 10 inches, and a force being applied to the apex at a middle of the corner until a fracture is detected, the resistance force being the force at which the corner fractures.

The corner can include an inner ply, made of several layers laminated together using an adhesive and forming a thick inner ply. Preferably, each of the layers has a thickness between 6 and 17 pts and the number of inner plies varies between about 1 and about 5. Alternatively, the inner ply can be made from a one or more thick layers or sheets, each of said layers having a thickness greater than 8 points, or more particularly, between 25 to 60 pts, for example.

The corner may be constructed according to two different configurations: overlapped or superimposed. In the overlapped configurations, the plies are combined together and folded into a plurality of overlapped sections. In the superimposed configuration, each ply can be folded separately and then superimposed and/or layered onto another similarly folded ply.

The paperboard used for the plies can be any appropriate and relatively thin paperboard such as liner cardboard, medium cardboard, and kraft cardboard. Other types of paperboard can include gypsum board. The plies can be made from a single type paperboard, or from a mix of different types of paperboard.

According to an exemplary variant of the invention, the paperboard form can include:

at least one inner ply;

a plurality of intermediate plies, each being wrapped around a previous one of the plies; and one outer ply, the outer ply being wrapped around the intermediate plies and affixed to an outermost one of the intermediate plies.

Any one of the intermediate plies can have a thickness between 4 and 17 pts, and the number of such plies can vary between about 1 and 5.

According to another aspect of the invention, there is also provided a method for creating an elongated corner for applying against a portion of a product during transport or packaging so as to protect the portion of the product, the method comprising the steps of:

providing at least two non-corrugated paperboard plies, each ply being made from a paperboard having a grammage of about 120 to about 380 g/m$^2$;

combining the at least two plies together;

folding the combined plies into a plurality of ply sections so as to create first and second wings intersecting substantially perpendicularly at an apex, the first and second wings having a thickness of about 100 to about 250 points; and overlapping at least one ply section of at least one ply over at least a part of another ply section of the same ply;

the apex having a resistance force of about 100 to about 500 lbs, the resistance force being obtainable by mounting the corner upon two blocks, both blocks being about 1.5 inches wide and separated by about 10 inches, and a force being applied to the apex at a middle of the corner until a fracture is detected, the resistance force being the force at which the corner fractures.

An adhesive can be used to combine the plies. The adhesive can be applied 1) on the entire surface of the plies, 2) on one of the extremities of the plies or 3) at both extremities of the plies.

Preferably, the paper products used are made from recycled and/or re-used materials.

The different plies and/or the corner as a whole may be coated with a substance or chemically treated so as to reinforce the structural integrity of the form, and so as to provide some water resistance.

The paperboard corner and manufacturing process thereof advantageously helps reduce the manufacturing costs of paperboard protective devices, since thinner plies can be used. Using thinner plies helps lower the overall manufacturing costs of the corners, and the wrapping of plies creates a stronger corner compared to conventional corners having a similar overall thickness.

The objects, advantages and other features of the present invention will become more apparent upon reading of the following non-restrictive description of preferred embodiments thereof, given for the purpose of exemplification only, with reference to the accompanying drawings.

BRIEF DESCRIPTION OF THE DRAWINGS

FIG. 20A is an end view of a conventional corner, while FIGS. 20B and 20C are top views of corners, according to other preferred embodiments of the invention.

DETAILED DESCRIPTION OF PREFERRED EMBODIMENTS OF THE INVENTION

In the following description, the same numerical references refer to similar elements. Furthermore, for the sake of simplicity and clarity, namely so as to not unduly burden the figures with several references numbers, not all figures contain references to all the components and features of the present invention and references to some components and features may be found in only one figure, and components and features of the present invention illustrated in other figures can be easily inferred therefrom. The embodiments, geometrical configurations, materials mentioned and/or dimensions shown in the figures are preferred, for exemplification purposes only.

Moreover, although the corner as herein described was primarily designed to be used to protect the corners and edges of merchandise during shipping and packaging, it may be used with other types of devices and/or products, and in other fields, as apparent to a person skilled in those arts.

Moreover, in the context of the present invention, the expression "ply" refers to a sheet of paperboard. A "ply" can be formed by a single layer of paperboard, or by several layers combined together, with an adhesive, for example. These combined layers may or may not be laminated.

The expressions "wrap" and "wrapping" are used in the sense of covering, enclosing or enveloping.

Furthermore, the expressions "bend" and "fold" are meant in the sense of curving, deflecting or forming a curvature in a ply or in the corner.

In addition, although the preferred embodiment of the present invention as illustrated in the accompanying drawings comprises various components and although the preferred embodiment of the paperboard corner as shown consists of certain geometrical configurations as explained and illustrated herein, not all of these components and geometries are essential to the invention and thus should not be taken in their restrictive sense, i.e. should not be taken as to limit the scope of the present invention.

Broadly described, the corner according to the present invention, as shown in the accompanying drawings, is a device which, in its preferred intended use, is an improved paperboard corner for protecting the corners or other parts of merchandise while being loaded into packaging or while being transported.

Paperboard Corner

Figure 1:
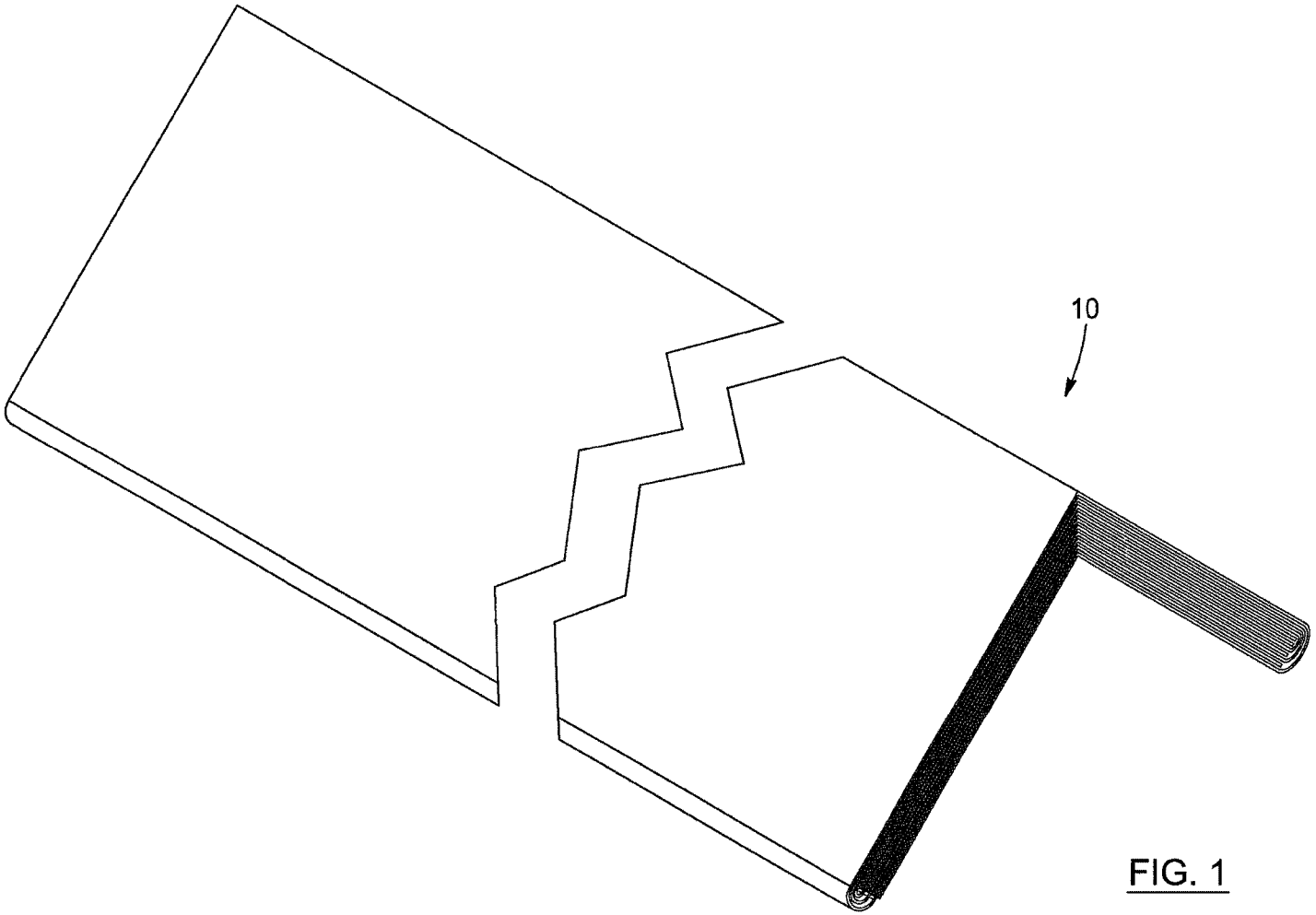
FIG. 1 is a perspective view of a corner, according a first preferred embodiment of the present invention.

Referring to FIG. 1, an elongated protective corner (or simply "corner") 10 for applying against a portion of a product during transport or packaging so as to protect the portion of the product is herein described. The term "corner" is not limited to a device having two extremities joined at roughly 90 degrees or an L-shaped piece, and can include any paperboard protector, having any shape, which is utilised to protect merchandise. Similarly, the use of the corner 10 for transport or packaging is given as an example only, and it is understood that the corner 10 can be used in other applications such as, but not limited to, strapping operations, etc. The term "elongated" as used herein can mean that the corner 10 is of any suitable length so as to protect that portion of the merchandise to which it is applied, as exemplified in FIG. 1. The expression "a portion of a product" can mean that the corner 10 is applied to all, or merely a part, of the product which it protects. For example, the corner 10 can be applied to only an uppermost edge of the product, rather than to the entire edge.

Referring to FIGS. 2 to 5, the corner 10 has at least two non-corrugated paperboard plies 20 combined together. The expression "non-corrugated paperboard" as used herein refers to paperboard that is not shaped into alternate ridges and grooves, and can include the following types of paperboard: liner cardboard, medium cardboard, kraft cardboard, and any other similar paper product. The term "paperboard" as used herein is not limited to paper or paper products of a particular density or grammage, and includes flexible, thick, pliable, and other appropriate paper products, of any suitable density or grammage. As explained above, the term "ply" as used herein can refer to a sheet of paperboard, which when folded as described below with other similar plies 20, creates the corner 10.

The plies 20 are combined together, for example with an adhesive, and then folded into partitions designated herein as ply sections 28. The ply sections 28 make up parts of the corner 10 that are created when the plies 20 are folded. These parts include a first wing 16 and a second wing 18, which intersect at roughly a right angle so as to form an apex 19. The first and second wings 16,18 can be rigid and slightly resilient members, which extend along the surfaces of the merchandise to which the corner 10 is applied. The wings 16,18 can stabilise the corner 10 against the merchandise. In many cases the corner 10 is attached by tensioned straps to the merchandise, and the wings 16,18 protect the areas of the merchandise adjacent to the edge from possible scuffing or scratching caused by the straps. The apex 19 can be any position, point, or juncture, where the wings 16,18 meet at a substantially ninety degree angle. The apex 19 can include an inner junction 19*a* corresponding to the inner side of the corner 10 (i.e. the side of the corner 10 applied to the product), and an opposed outer junction 19*b* corresponding to the outer side of the corner 10. The apex has a resistance force of about 200 to about 400 lbs, as determined according to the experiment described below.

Figure 3:
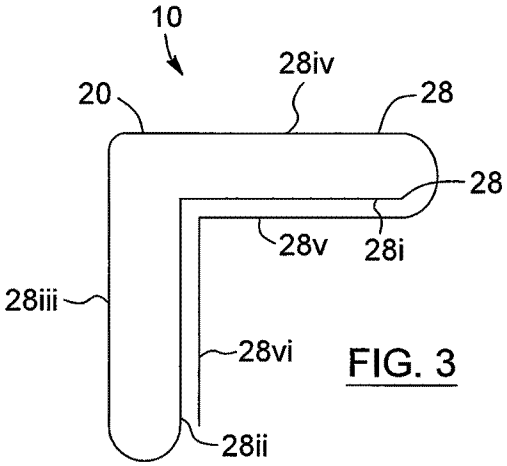
FIG. 3 is an end view of a corner according to a different preferred embodiment of the present invention.

Each ply 20 has at least one ply section 28 which overlaps, at least partially, another ply section 28 of the same or different ply 20. This feature is exemplified in FIG. 3. Each ply 20 can have many ply sections 28. For the purposes of describing the feature of overlapping ply sections 28, assume that a ply 20 can have six ply sections 28*i*,28*ii*,28*iii*, 28*iv*,28*v*,28*vi*. As can be seen, the fifth ply section 28*v* overlaps the first ply section 28*i*. In this exemplary corner 10, the fifth ply section 28*v* completely overlaps the first ply section 28*i*, although it is within the scope of the present invention that the fifth ply section 28*v*, or any other ply section 28, could overlap another ply section 28 only partially. It also within the scope of the present invention that more than one ply section 28 of a given ply 20 can overlap more than one other ply section 28. For example, and as shown in FIG. 3, the fifth ply section 28*v* overlaps the first ply section 28*i*, and the sixth ply section 28*vi* overlaps the second ply section 28*ii*. Overlapping ply sections 28 can advantageously increase the resistance force, as described in more detail below, of a given corner 10 when compared to conventional corners in which the ply sections are not overlapped. Furthermore, the overlapping ply section 28 can allow for a thinner paperboard material to be used, procuring important cost savings.

Figure 5:
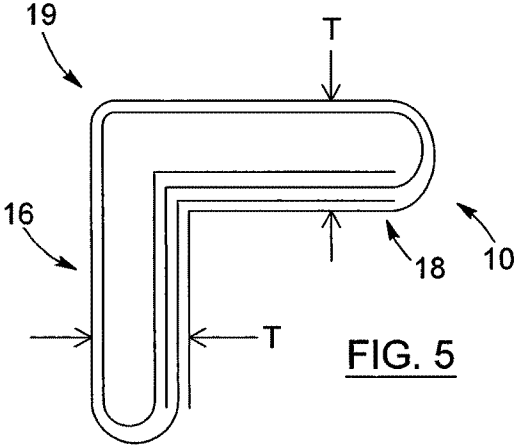
FIG. 5 is an end view of a corner according to a different preferred embodiment of the present invention.

As shown in FIG. 5, the first and second wings 16,18 have a thickness T in the range of about 100 to about 250 points. This thickness T can vary, as discussed below, which can affect the resistance force of the corner 10. The thickness T can ensure that support and protection is provided for, and against, the attachment device (i.e. strap, belt, etc.) used to apply and hold the corner 10 to the product. Both wings 16,18 can have the same thickness T, or can have different thicknesses T, depending on the particular application for which the corner 10 will be used.

Each ply is made from a paperboard having a grammage of about 120 to about 380 g/m$^2$. The term "grammage" is understood in the art of paperboard products to refer to the basis weight or area density of a particular paperboard. It is used to denote a measure of mass of the paperboard product, in g, per unit of area, m$^2$.

Figure 2:
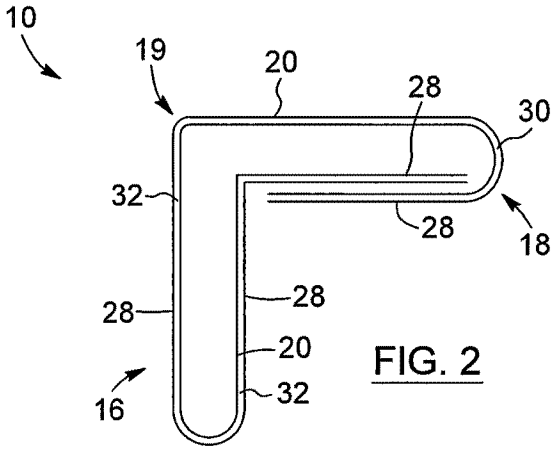
FIG. 2 is an end view a corner, according to a second preferred embodiment of the present invention.

Referring now to FIG. 2, each ply 20 can be adhered together with another ply 20 so as to form an overlapped ply 30. The plies 20 can be adhered together by adhesive, or by other techniques known in the art. The overlapped ply 30 being thus formed, it can then be folded into many overlapped sections 32, which can fold as described herein so as to form the wings 16,18 and the apex 19. At least one overlapped section 32 overlaps another overlapped section 32, or many overlapped sections 32, of the same or different overlapped ply 30, as described above.

Figure 4:
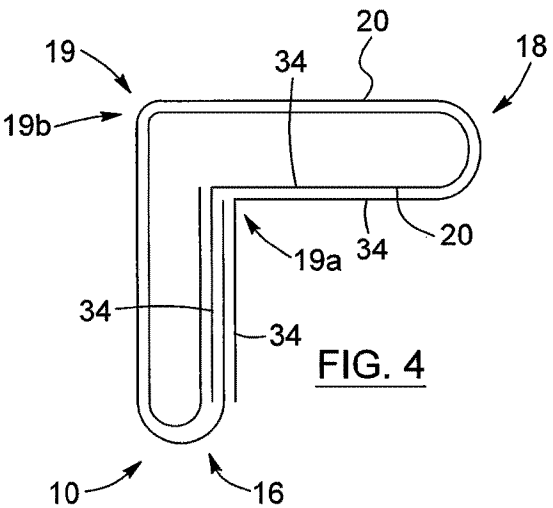
FIG. 4 is an end view a corner, according to a third preferred embodiment of the present invention.

Referring to FIGS. 4 and 5, the plies 20 can be superimposed. By "superimposed", it is understood that the plies 20 can be laid one over the other. In other words, a first folded ply 20 can be made, a second ply 20 can be folded around the first ply 20, and so forth. Alternatively, subsequent plies 20 can be stacked or inserted around preceding plies 20. In such a configuration, the first ply 20 may be folded into serial sections 34 which are folded as described below so as to form a part of the wings 16,18 and the apex 19, and which overlap at least partially at least one other serial section 34. Subsequent plies 20 can be similarly folded and superimposed onto the preceding ply 20, thus completing the wings 16,18 and the apex 19 of the corner 10.

Referring to FIGS. 6 to 9, different exemplary variants of a corner 10 are shown. Each of the corners 10 illustrated comprises an inner ply 22 and an outer ply 26, the outer ply being wrapped around the inner ply 22. The corners 10 are bent at approximately 90 degrees, each having an inner side 12 and an outer side 14. Of course, the corners 10 can have any convenient length. Also, other embodiments of the corner could also have any other convenient shape, such as a C-shape or even a linear shape.

On the inner side 12, impact forces can be absorbed and diffused by the multiple overlapping ply sections (28*i*, 28*ii*, 28*iii*, for example, in FIG. 3). In order to provide symmetry to the corner 10, or in other words, in order for the corner 10 to have the same thickness on both sides on the inner ply 22, additional plies can be added to the corner 10, thereby providing corners with similar robustness characteristics on both inner and outer sides 12,14.

Figure 10:
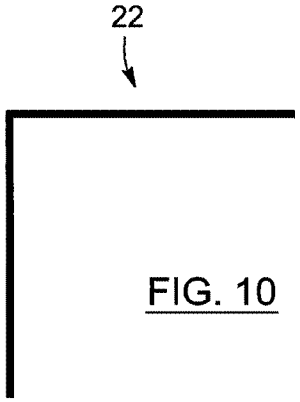
FIG. 10 is an end view of a first variant of an inner ply.

Now referring to FIGS. 10 to 13, different variants of inner plies 22, also referred to as the inner core, are shown. As illustrated in FIG. 10, the inner ply 22 can be made of a single thick cardboard ply, for example having a thickness greater than 45 pts.

Figure 11:
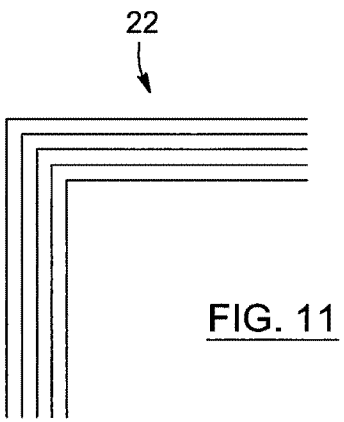
FIG. 11 is an end view of a second variant of an inner ply.

In FIG. 11, the inner ply 22 can instead be made of laminated layers of thinner paperboard, each layer having for example a thickness of less than 20 pts. The layers can be affixed to one another with an adhesive, applied either on the entire surface of the layers or at their ends only. Alternatively, the inner ply 22 can consist of several layers having a thickness of 25 to 35 pts. The layers of the inner ply 22 can also have thicknesses varying between 25 to 60 pts.

Figure 12:
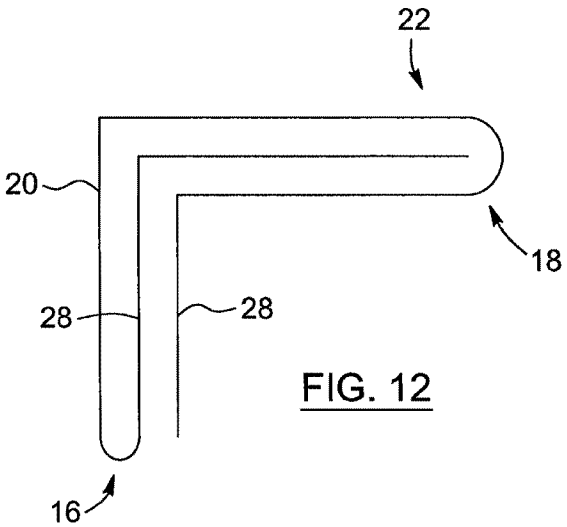
FIG. 12 is an end view of a third variant of an inner ply.
Figure 13:
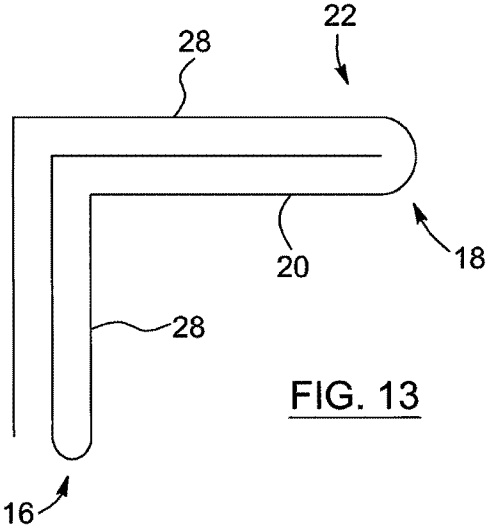
FIG. 13 is an end view of a fourth variant of an inner ply.

In FIGS. 12 and 13, inner plies 22 can be made by folding a paperboard ply 20 so as to have ply sections 28 overlapping one another. While FIGS. 12 and 13 show inner plies 22 folded in six ply sections 28 each, inner plies 22 can also be made with plies having three, four, five, seven or more folded ply sections 28. Having the inner ply 22 folded in an even number of ply sections 28 advantageously provides the inner ply 22 with wings 16,18 having similar thicknesses and thus being substantially symmetrical.

Turning back to FIGS. 6 to 9, the inner ply 22 of the corners 10 illustrated corresponds to the variant illustrated in FIG. 10. Of course, any variant of the inner ply 22 could be used instead, such as the ones illustrated in FIGS. 11 to 13 for example.

Figure 6:
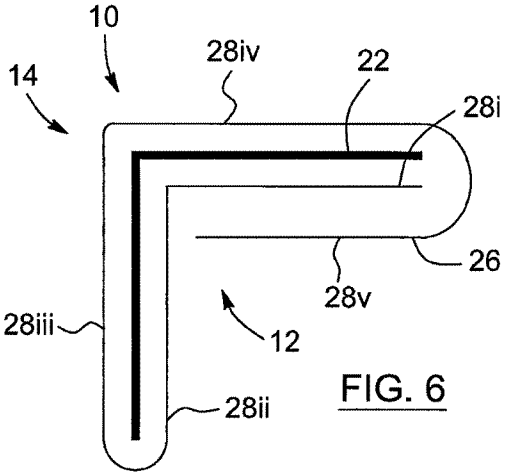
FIG. 6 is an end view of a corner having an inner ply, according to a fourth preferred embodiment of the present invention.
Figure 7:
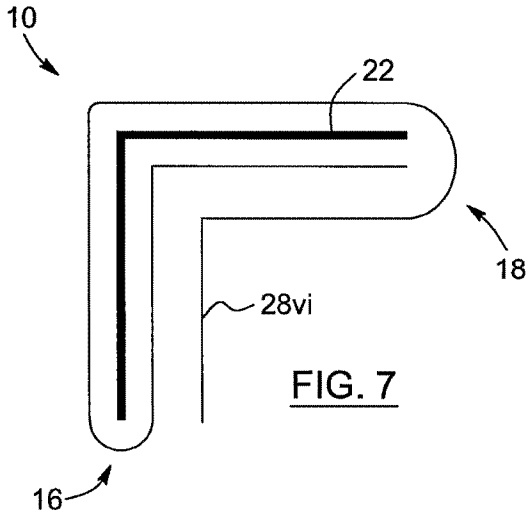
FIG. 7 is an end view of a corner according to a different preferred embodiment of the present invention.

In FIG. 6, the outer ply 26 comprises five ply sections 28*i*,28*ii*,28*iii*,28*iv*,28*v* which can be folded around the inner ply 22 in the following manner: the first and the second ply sections 28*i*,28*ii* of the outer ply 26 are aligned with (or are facing) the inner side 12 of the inner bent ply 14. In FIG. 6, the folding of the outer ply 26 begins on the inner side 12 of the corner 10. The outer ply 26 is folded, or bent, between the second and the third ply sections 28*ii*,28*iii* at a point of curvature, and the third and fourth ply sections 28*iii*,28*iv* are aligned with (or facing) the outer side 14 of the inner bent ply 14. The outer ply 26 is folded a second time, between the fourth and the fifth ply sections 28*iv*,28*v* such that the fifth ply section 28*v* of the outer ply 26 is aligned with the inner bent ply 14, adjacent to the first ply section 28*i*.

Figure 9:
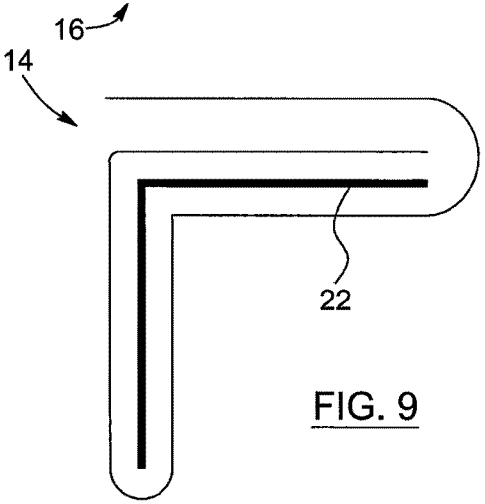
FIG. 9 is an end view of a corner having an inner ply, according to a sixth preferred embodiment of the present invention.

Of course, in other embodiments of the corner 10, such as the one illustrated in FIG. 9, the folding of the inner ply 22 can begin on the outer side 14 of the inner ply 22.

In addition, it is possible for the outer ply 26 to be provided with more or fewer ply sections 28, for example, it may comprise three ply sections 28 that would wrap partially the inner ply 22. In the embodiment shown in FIG. 7, the corner 10 is provided with a sixth ply section 28*vi*, providing the corner 10 with two 90 degree wings 16,18 of similar thickness T.

Figure 8:
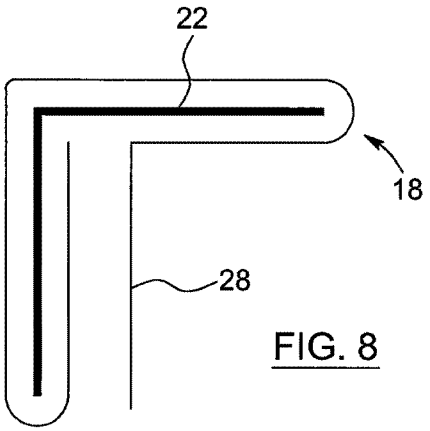
FIG. 8 is an end view of a corner having an inner ply, according to a fifth preferred embodiment of the present invention.

Referring to FIG. 8, another variant of a corner 10 is shown. In this variant, the folding of the outer ply 26 over the inner ply 22 begins near the location where the inner ply 22 is bent, or in other words at the midpoint of the inner ply 22. Of course, in yet other variants of the invention, the folding of the outer ply 26 does not need to begin at an extremity of the inner ply 22, but can begin at any point along either one of the wings 16,18.

Figure 14:
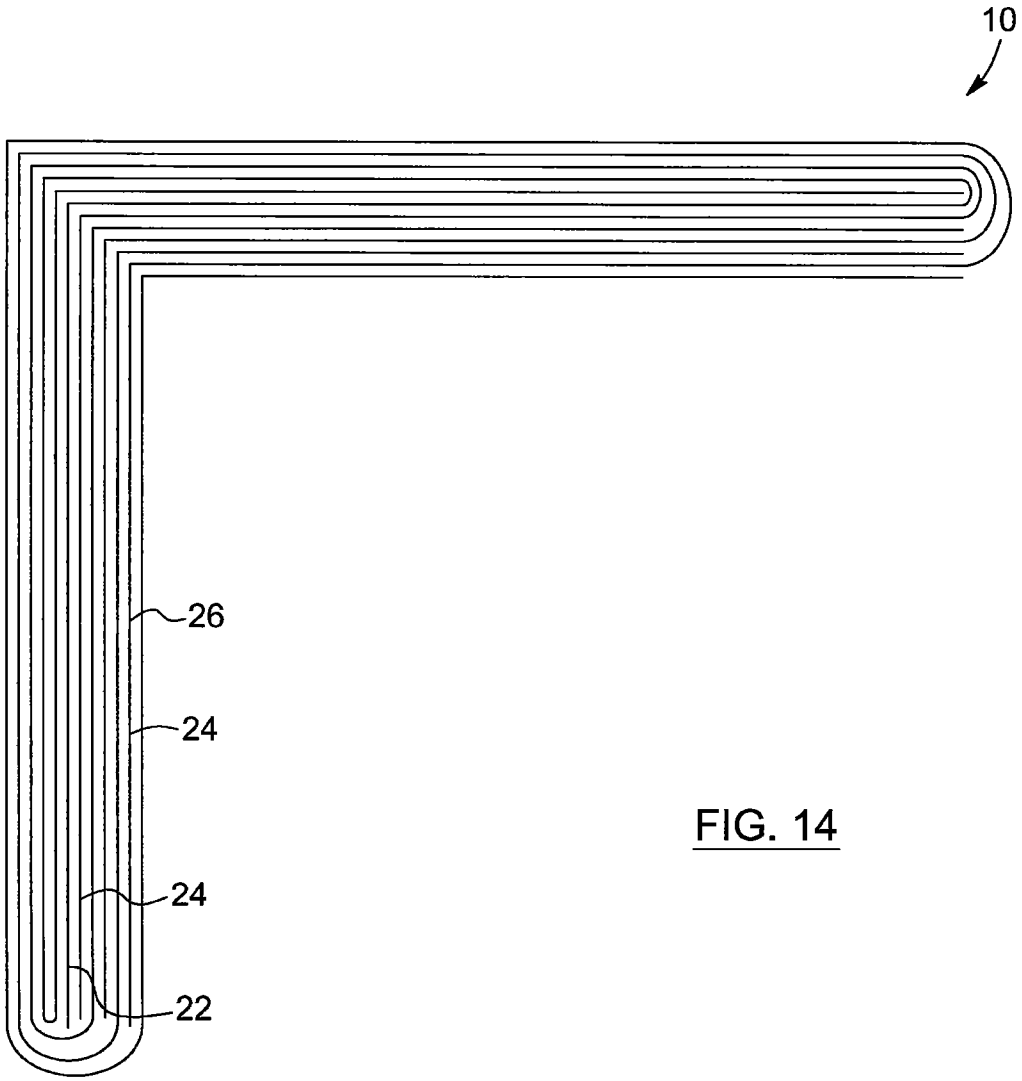
FIG. 14 is an end view of a corner, according a seventh preferred embodiment of the present invention.
Figure 15:
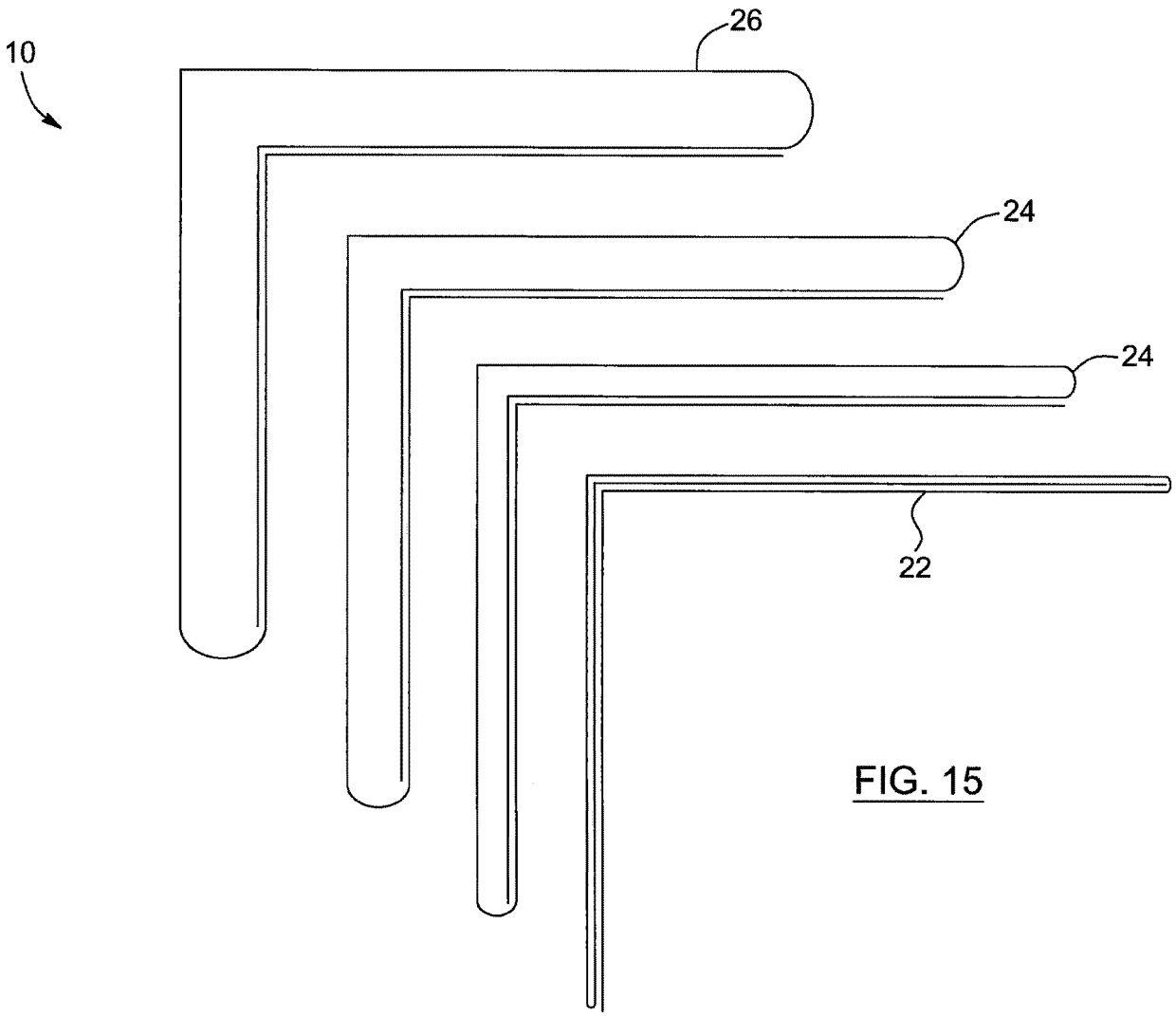
FIG. 15 is an end exploded view of the corner shown in FIG. 14.

Now referring to FIGS. 14 and 15, another preferred embodiment of a corner 10 is shown. The corner 10 comprises four components: an inner ply 22, two intermediate plies 24 and an outer ply 26.

The inner ply 22 preferably forms a first layer of the core of the corner 10. In this variant of the corner 10, the inner ply 22 can be folded onto itself and is best shown in FIG. 15.

Referring to FIG. 14, the intermediate plies 24 can be folded around the inner ply 22, thus providing further structural support to the corner 10. The number of intermediate plies 24 to be used for a given corner 10 depends on many factors such as, but not limited to: the product and/or portion of the product to be protected, the desired structural properties of the corner 10, cost of the corner 10, thickness constraints, etc.

In this exemplary variant of the corner 10, the innermost intermediate ply 24 is wrapped around the inner ply 22, and the outermost intermediate ply 24 is wrapped around both the inner ply 22 and the innermost intermediate ply 24. This variant of the corner 10 yet includes another ply, the outer ply 26, which is wrapped around the inner ply 22 and the two intermediate plies 24.

FIG. 15 shows with greater clarity how the plies 24 and 22 are folded and shaped so as to completely enclose and surround each previous ply 20 of the corner 10. Each of the plies 22,24,26 forming the corner 10 are preferably made with paperboard having a thickness varying between 4 and 20 pts, and preferably between 5 and 15 pts.

Now with reference to FIGS. 16, 17, 18A, 18B, and 19, other preferred embodiments of the corner 10 are shown. In these embodiments, the inner ply 22 is not formed by overlapping ply sections, such as the one shown in FIG. 15, but instead is simply bent at one location, such as at the apex 19, thereby forming wings 16,18 substantially perpendicular to one another. Of course, while shown with an angle of 90 degrees, other variants of the corner 10 could be formed with the wings 16,18 forming an acute or an obtuse angle.

Figure 16:
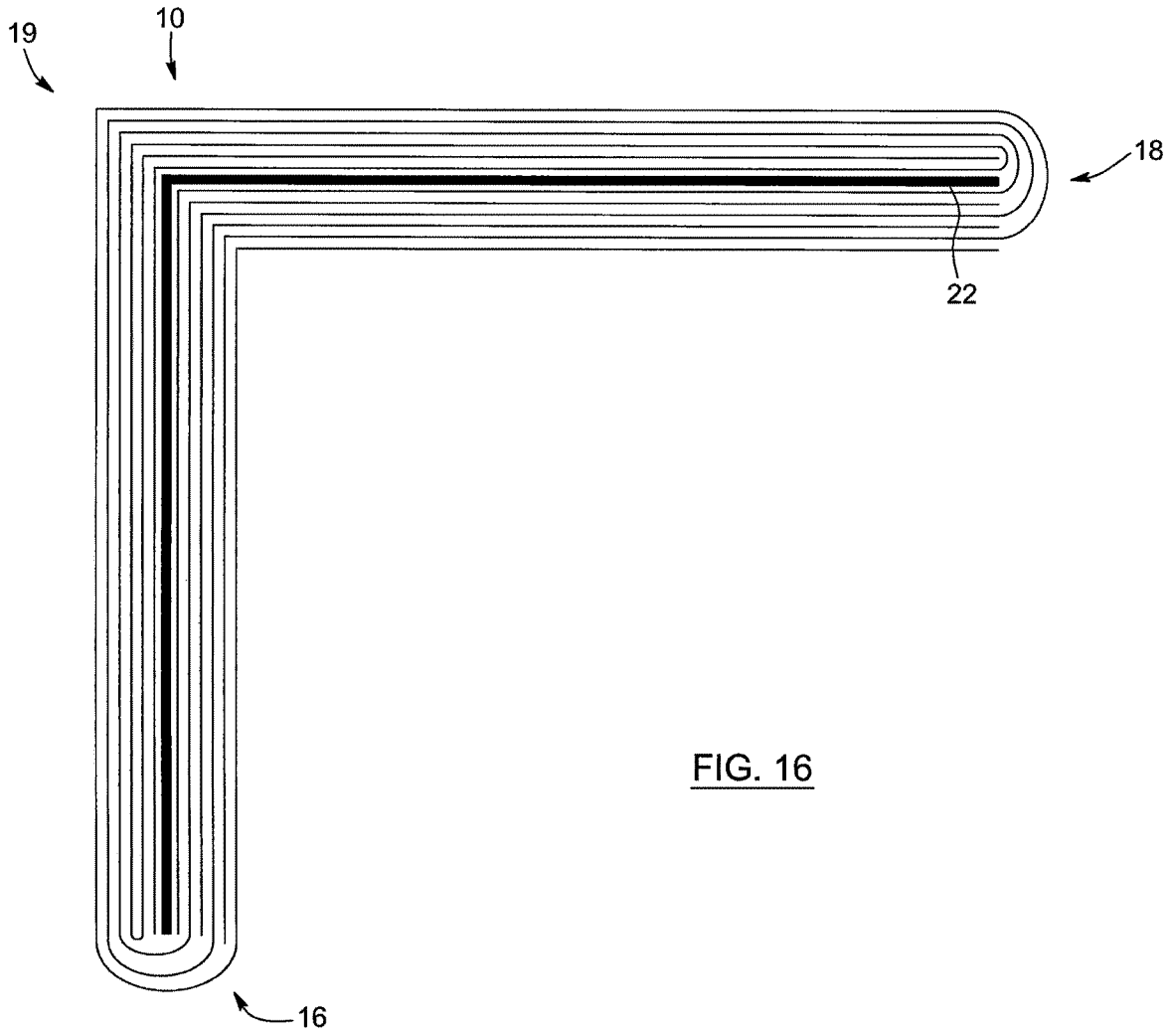
FIG. 16 is an end view of a corner having a thick inner ply, according to a eight preferred embodiment of the present invention.

Now with reference to FIG. 16, the inner ply 22 can be made of a single, thick sheet of paperboard, such as the one illustrated in FIG. 10. In this preferred embodiment, the inner ply 22 is bent to form to the shape of the portion of the product to be protected. It is preferably thicker than the intermediate 24 and outer 26 plies that are wrapped around it so as to provide a strong core to the corner 10, which is better able to resist impact and shear forces which may result during the loading and transport of the product or merchandise.

Figure 17:
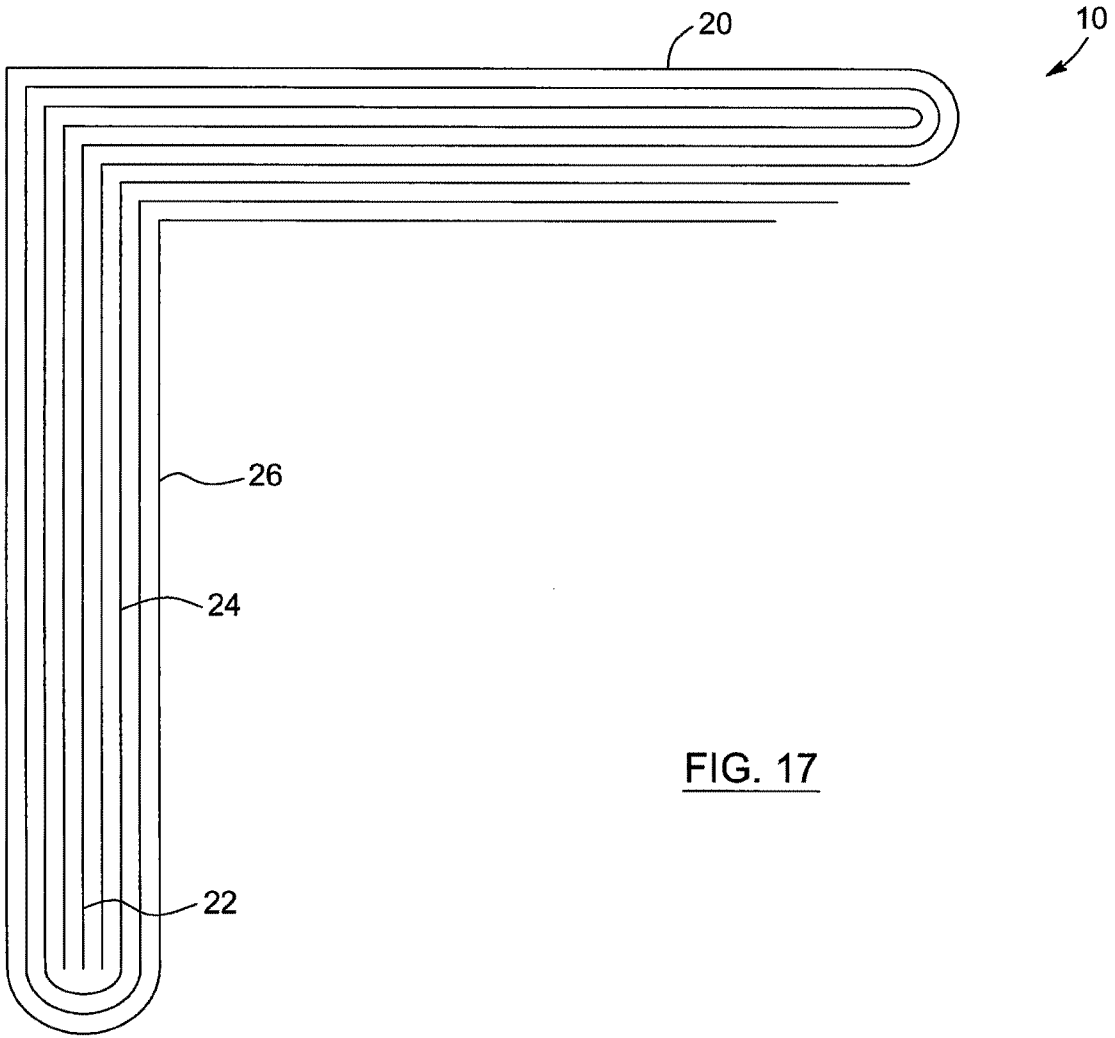
FIG. 17 is an end view of a corner according to a ninth preferred embodiment of the present invention.

Referring to FIG. 17, in this variant of the corner 10, the inner ply 22, the intermediate ply 24, and the outer ply 26 can be simply laid one atop the other and simultaneously bent together, similarly to the inner ply 22 shown in FIG. 11. The stacked plies 22,24,26 forming the corner 10 can optionally be glued to one another using an adhesive. Alternatively, the inner ply 22, the intermediate ply 24, and the outer ply 26 can each be bent into the desired shape individually, and then stacked to create the corner 10, each ply 20 being connected by an adhesive or mechanical fastener, as apparent to one skilled in the art.

Figure 18B:
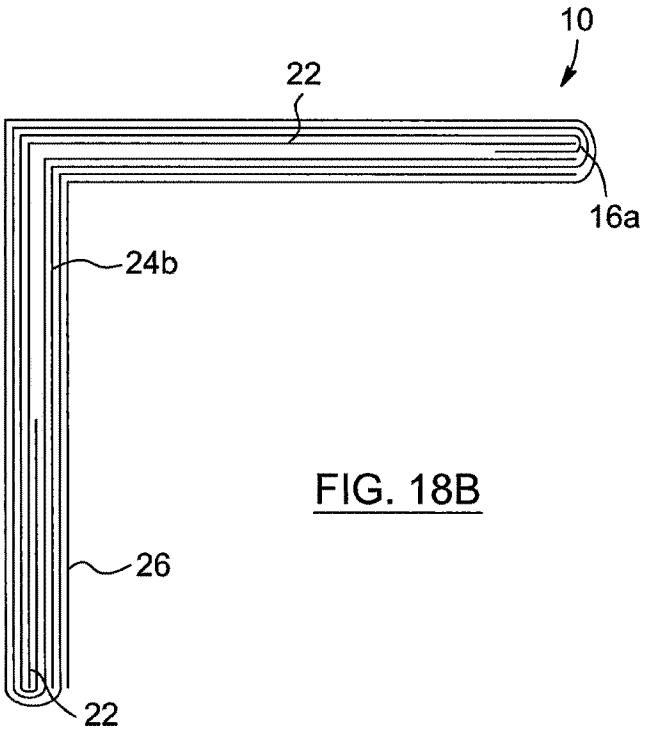
FIGS. 18A and 18B are end views of corners, according to other preferred embodiments of the present invention.
Figure 18A:
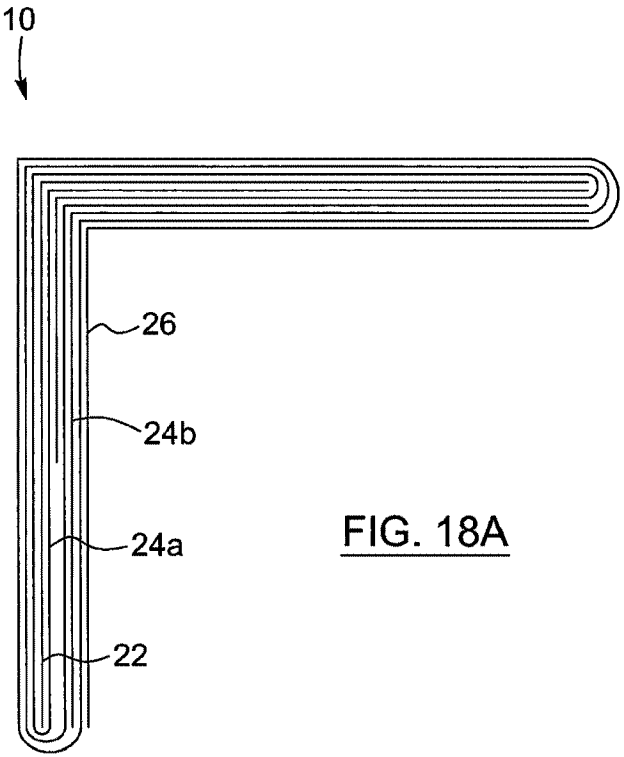

Referring to FIGS. 18A and 18B, the corners 10 illustrated are formed by an inner ply 22, which is not folded on itself in multiple sections but rather formed by a single ply 20 bent at its midpoint.

In the variant illustrated in FIG. 18A, the innermost intermediate ply 24*a* is only partially wrapped around the inner ply 22. The outermost intermediate ply 24*b* completely folds around the plies 22 and 24*a*. The outer ply 26 in turn completely folds about the plies 22,24*a*,24*b*, in a similar fashion as the ply 26 shown in FIG. 15.

In the variant illustrated in FIG. 18B, both intermediate plies 24*a* and 24*b* are only partially wrapped around the previous ply. The outermost ply 26 completely wraps around plies 22, 24*a* and 24*b*. These variants of the corner 10 advantageously require less paper material and thus allow for reducing the manufacturing costs and weight of the corners 10. With the variant illustrated in FIG. 18B, the fact that fewer layers of cardboard are present near the bending point of the corner 10 also improves the flexibility of the corner 10 at this point. A further advantage of this variant is that a cutting implement can be inserted through the corner 10 in the gaps formed, thereby preventing the product from being nicked or scratched.

Figure 19:
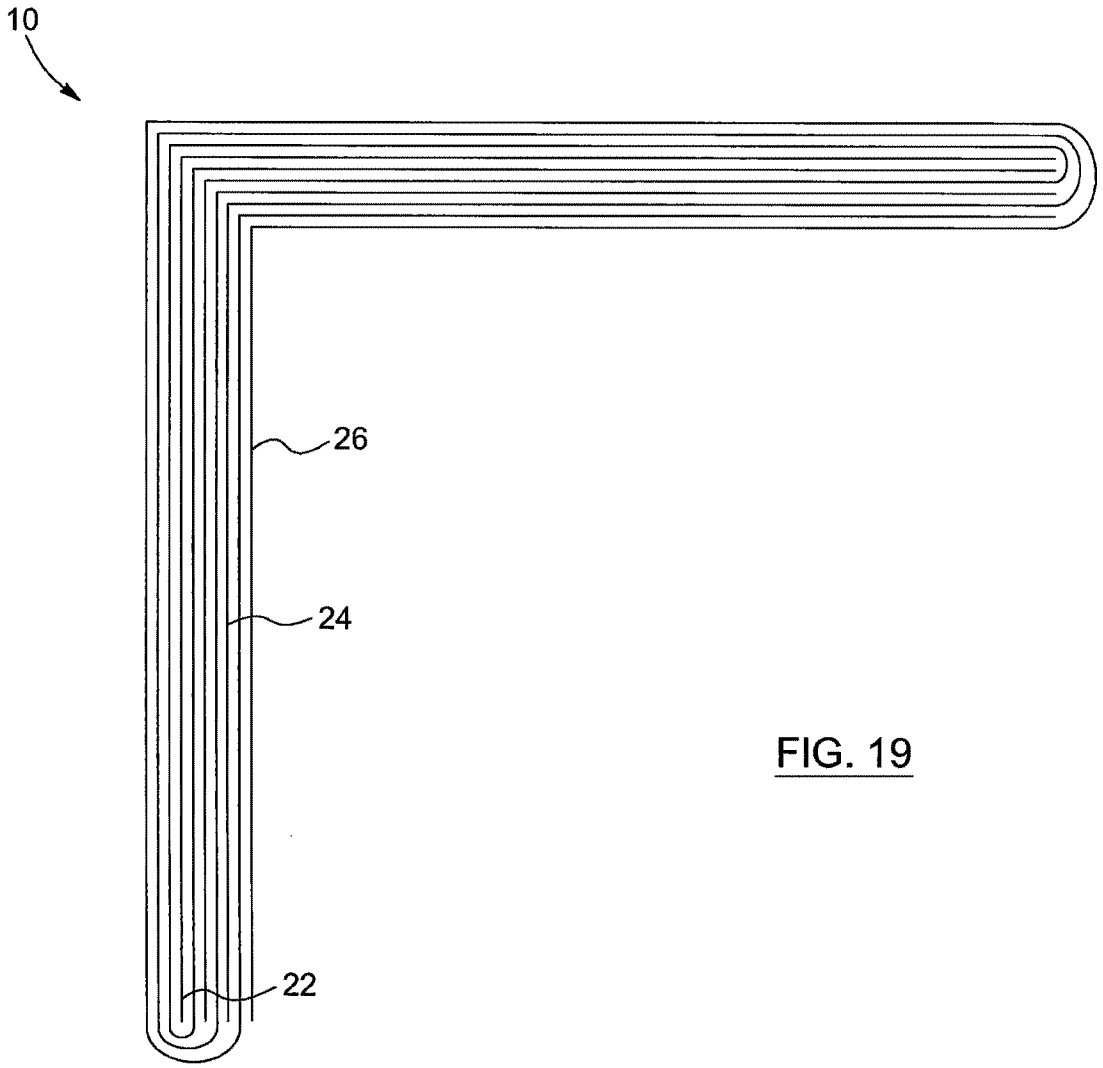
FIG. 19 is an end view of a corner, according to a tenth preferred embodiment of the invention.

With reference to FIG. 19, yet another embodiment of the corner 10 is shown. In this embodiment, the inner ply 22 simply consists of a single ply bent about a bending point, at its midpoint. An intermediate ply 24 is wrapped around the single inner ply 22 and the outer ply 26 is wrapped around the intermediate ply 24. All plies 22,24,26 of the corner 10 are made from relatively thin paperboard, with thicknesses preferably varying between 4 and 14 pts. Optionally, one or all of the plies 20 can be provided with water-absorption resistance, by coating it with a water repellent substance. Alternatively, one of the plies can be plasticized.

Of course, the corners 10 may come in different lengths and the wings 16,18 may vary in width and thickness. Some exemplary dimensions of wings 16,18 include 2"×2", 2.5"×2.5", 3"×3", etc. The corners 10 may be used in different types of application, for example to protect furniture, bulk products or for strapping agricultural products.

Preferably, all the plies 20 are made from a paperboard, although each ply 20 does not need to be made from the same paper product, as apparent to a person skilled in the art. In addition, plies 20 made of different paper products may be used in a single corner 10.

Preferably, an adhesive such as glue may be used to adhere some and/or all of the plies 20 together. The thickness of the plies 20 is preferably in the range of 4 to 10 points and the number of plies used may be in the range of 2 to 8.

Still preferably, the number of plies used may be in the order of 25 for applications where strong protection is required for the product, which can result in a corner 10 with a total thickness of around 160 points.

Manufacturing Method of the Paperboard Corner

According to another aspect of the invention, there is also provided a method for manufacturing the paperboard corner 10.

The method consists of providing at least two non-corrugated paperboard plies, each ply being made from a paperboard having a grammage of about 120 to about 380 g/m$^2$. These plies are then combined together, so as to form an overlapped ply, for example. Once combined, the plies are folded into a plurality of ply sections so as to create first and second wings and an apex, as described above. The first and second wings have a thickness of about 100 to about 250 points. Then, at least one ply section is overlapped over at least a part of another ply section of the same ply. The apex is characterised in that it has a resistance force of about 100 to about 500 lbs, as determined by the test described below. Once overlapped, the corner 10 so produced can be cut to a desired length either automatically or manually.

Alternatively, the method can consist of the following steps. First, an inner ply 22 is provided having a predetermined thickness and is then folded with an outer ply 26. The inner ply 22 may have been previously bent. In this case, when wrapping the outer ply 26 around the inner ply 22, the outer ply 26 must be folded at both ends of the inner ply 4 but also at its bending point, in order to form or follow the contour of the bent inner ply 22. Alternatively, the inner ply 22 may be flat, or linear, and the outer ply 26 is wrapped around the flat, unbent inner flat ply 22. In this latter case, the bending step required to provide the corner with an angled or corner-like shape is performed after the wrapping step.

Of course, the step of wrapping the bent inner ply 22 with an outer ply 26 can be repeated several times with additional plies.

Preferably also, an adhesive can be applied between plies. The adhesive can be applied 1) on the entire surface of the plies or any portion thereof, 2) on one of the extremities of the plies or 3) at both extremities of the plies.

As it can be appreciated, the use of longer plies which are folded and wrapped over an inner ply reduce the total number of plies required for a given corner 10 while at the same time providing the same features and advantages, for example in terms of rigidity or tearing resistance.

Furthermore, the method described above advantageously allows for "in-line" manufacturing, as the steps of combining, folding, and overlapping can be completed with reels, conveyors, and other similar machinery. This procures significant cost and efficiency gains, and allows for a more uniform corner 10 to be produced rapidly.

Experiments Measuring Resistance Force as a Function of Corner/Wing Thickness

Experiments were conducted to determine the resistance force of the corner 10 described above. The resistance force is an important parameter in the field of corners 10 because it is a measure of the force that the corner is able to resist when a force or a pressure is applied to the corner 10, principally to its apex 19. The resistance force has an important practical application as well. Typically, and as mentioned above, corners are placed against the product to be protected and then strapped in place. This strapping action applies pressure to the wings 16,18 and apex 19 of the corner 10. The wings 16,18, usually disposed more or less flat against the product, are not often affected by the force applied by the strap. The apex 19, however, receives the strapping force directly and can there buckle or tear as a result of the force. Therefore, the corner 10, and more particularly the apex 19, should be able to resist forces generated by straps in the industry.

Figure 21:
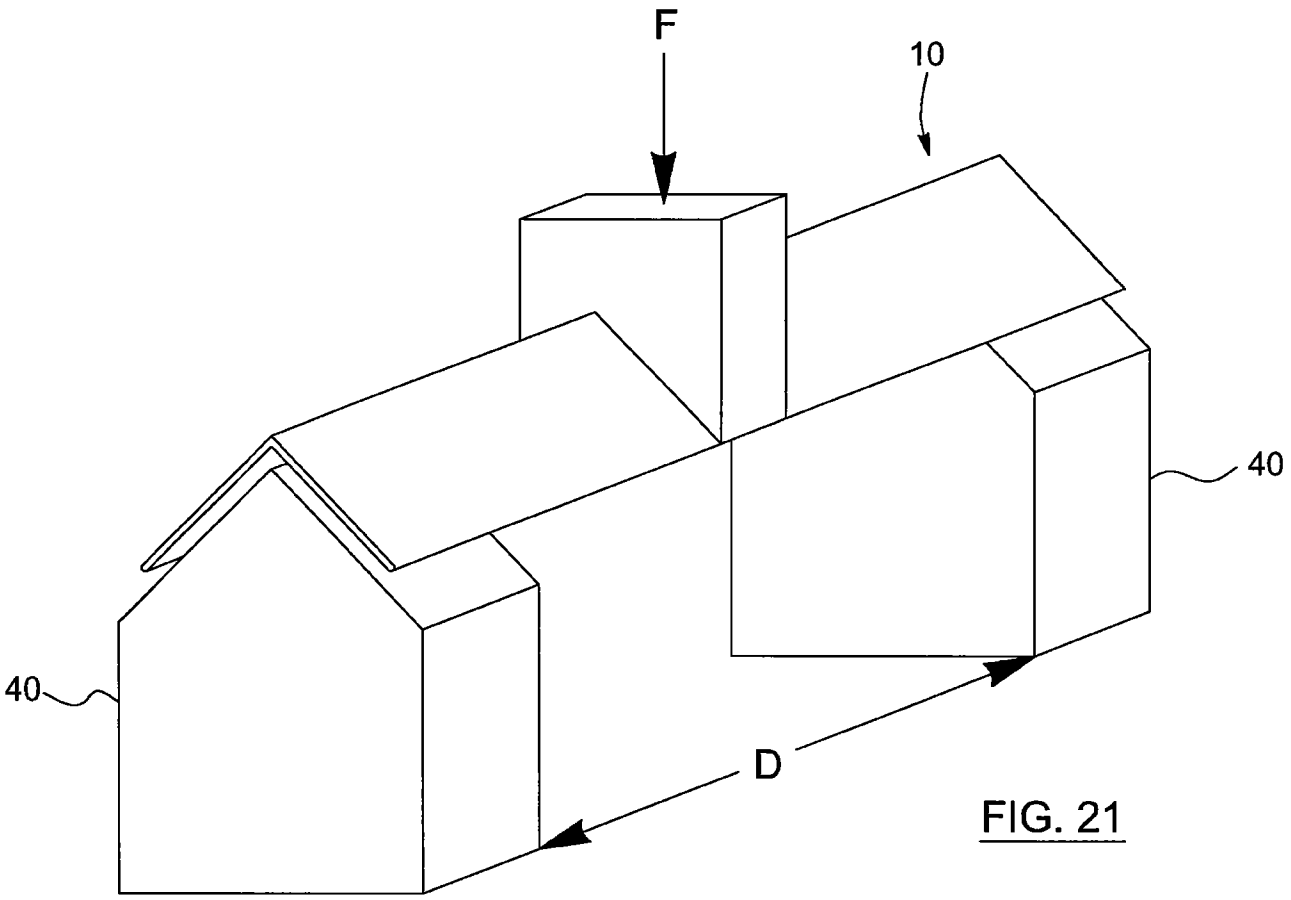
FIG. 21 is schematic perspective view of a testing machine used to determine a resistance force.

As can be seen from the results tabled below, and from the graph in FIG. 22, it is appreciated that each additional ply folded around a preceding one into the desired shape greatly increases the resistance force of the corner 10, while not necessarily adding to its thickness. Referring to FIG. 21, the resistance force is determined by an experiment. A corner 10 is placed on two blocks 40, each block being 1.5 inches in width and being separated by about a distance D of about 10 inches. A force F is applied at a rate of roughly 2"/minute to the middle of the corner 10 so mounted, at the apex 19, and the force F measured at the moment that the corner 10 fractures is the resistance force. Thus, in the following experiment, corners 10 of different wing dimensions (i.e. width and length) and different thicknesses, were supported and affixed to the blocks 40 which were placed at each end of the corner 10. A vertical load was then applied to the middle of the corner 10, at the apex 19, until the middle fractured. The term "fractured" in the context of the present invention can mean the moment that a tear or rupture was visually observed in the corner 10. The resistance force is the force recorded when the middle of the corner began to fracture. The following table provides some results.

TABLE 1

Resistance Force as a Function of Wing Thickness

| Wing Thickness (points) | Resistance Force (in lbs) |
|---|---|
| 90 | 101 |
| 100 | 147 |
| 120 | 141 |
| 140 | 205 |
| 150 | 267 |
| 160 | 333 |
| 170 | 381 |
| 190 | 476 |
| 200 | 453 |
| 225 | 659 |

The values included in Table 1 are averaged from many raw data measurements taken from corners having two or more plies so as to provide a representative data sample. As Table 1 illustrates, the thickness of the wings and the resistance force of the corner 10 are directly related. Indeed, as the thickness of the wings increases, the resistance force of the corner 10 and/or apex 19 increases as well, in a substantially exponential manner.

Figure 22:
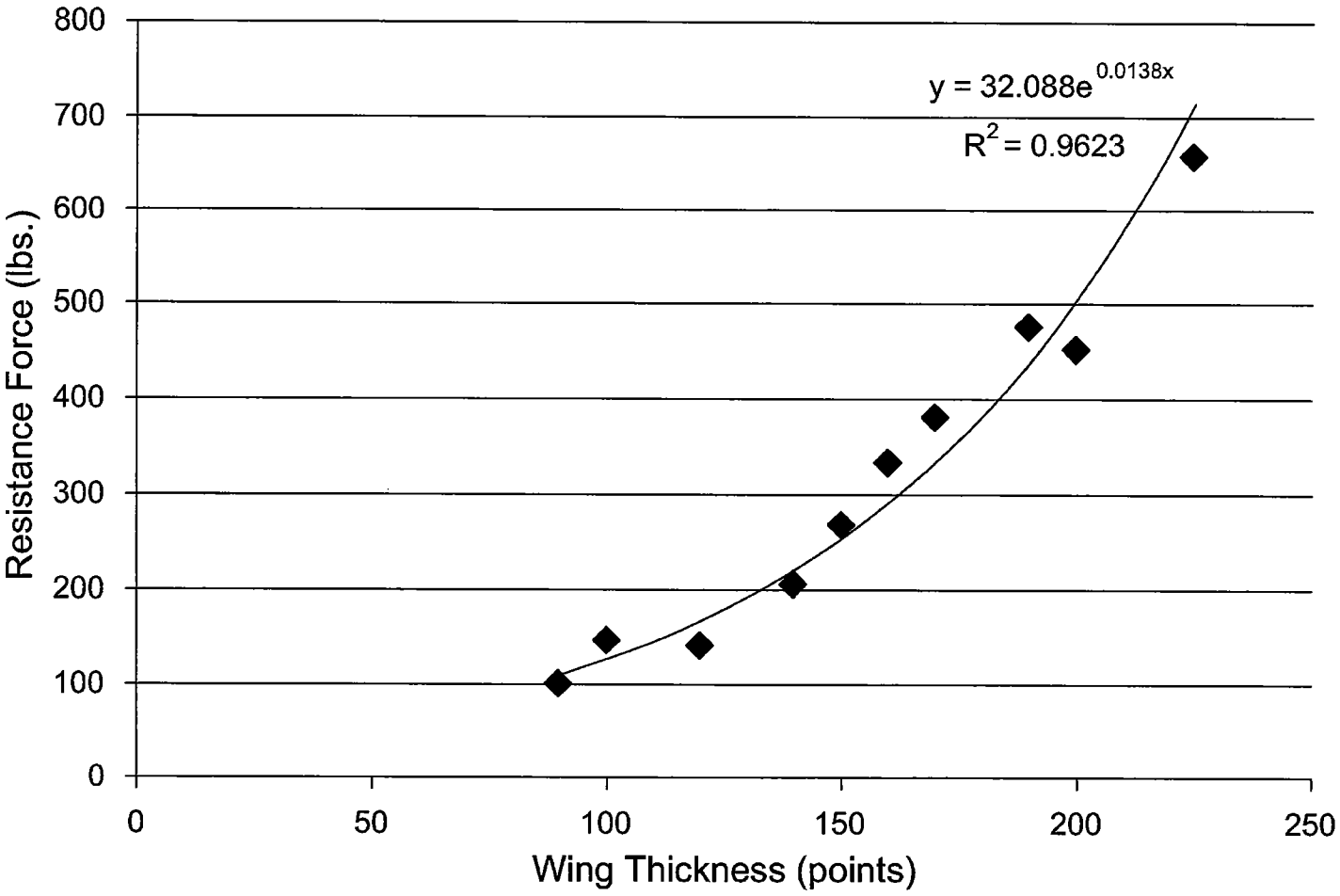
FIG. 22 is a graph showing resistance force as a function of corner wing thickness.

FIG. 22 provides a visual representation of this relationship. As can be seen, the approximate data curve is characterised by the following exponential equation:

$$\text{Resistance Force}=32.088e^{0.0138\times Thickness}$$

This equation is a characterisation of the data curve, having a coefficient of determination (i.e. $R^2$ value) of about 0.96. Of course, it is understood that the values "32.088" and "0.0138" can easily vary, for example from 20 to 40 for the multiplicative coefficient, and from 0.01 to 0.02 for the exponent, and are given solely to demonstrate that the probable relationship of thickness with resistance force is exponential in nature.

It was determined that traditional corners, by contrast, often have a simple linear relationship between thickness and resistance force. Therefore, the corner 10 described herein procures a significant advantage in that it not only provides an exponential increase in the resistance force, but is also able to affect customer requirements. For example, it is known in the industry that customers often order their corners based solely on thickness requirements. Given the problems described in the Background section regarding the inconsistent physical properties of conventional corners of equivalent thicknesses, this technique of procuring corners often led to customers receiving corners that did not provide a sufficient resistance force. Now, with the properties and advantages of the present corner 10, customers can instead order by asking for corners with a given resistance force. Since the corner 10 described herein presents relatively uniform properties that vary little from corner 10 to corner 10, and because it can easily meet the resistance force needs of customers because of its substantially exponential properties, customers can be assured that their packaging needs are met. In addition, since overlapping of the ply sections for several or all the layers increases the force resistance at the apex, compared to when the ply sections are not overlapped, this allows reducing the thickness of the wings and thus the cost to manufacture the corners, since less paper layers are required. Indeed, experiments conducted on similarly-dimensioned winged corners which have folded plies, but which do not have overlapping ply sections, show that a significantly lower resistance force is obtained. Consider for example a 2"×2" folded (but no overlapping ply sections) corner, having a wing thickness of about 130 points. This corner provides a resistance force between about 140 to about 165 lbs. A comparable corner according to the present invention (2"×2", 140 points) provides a resistance force of about 205 lbs.

As explained earlier, conventional unwrapped paperboard corners known in the art demonstrate an increase in resistance force as the thickness of the wall is increased. The table also demonstrates the advantages of the present invention over the prior art, namely, that the addition of folded plies, even for thinner corners, significantly increases the corner's resistance force. For example, the resistance force for a 2"×2" 2-ply corner having a wing thickness of 0.160 in is in the range of 192-215 lbs. By adding an additional ply to that same corner (i.e. 3-ply) and keeping the same thickness (ie 0.160 in), the resistance force increases significantly to 341-384 lbs. Therefore, it is apparent that the addition of folded plies contributes greatly to the ability of the corner to resist structural forces which it encounters when being used. Preliminary experiments tend to show that the resistance force of corners made from three or more folded plies increases exponentially, rather than linearly, as one would expect.

Figure 23:
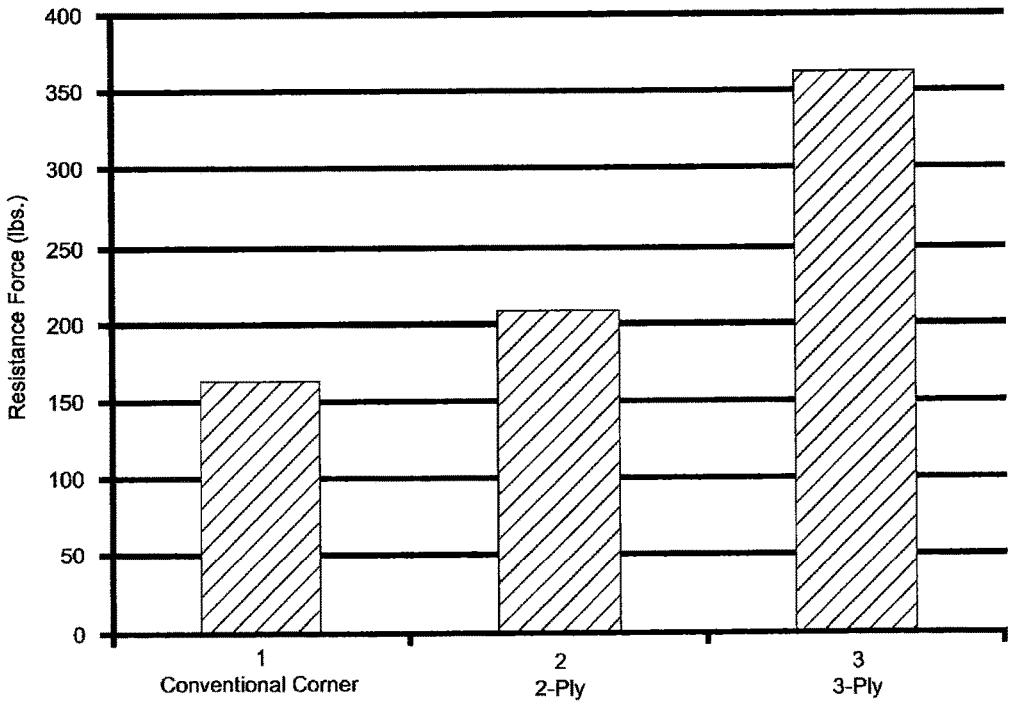
FIG. 23 is a graph showing resistance force for three types of corners including a conventional corner and 2-ply and 3-ply corners according to some embodiments of the present invention.

FIG. 23 illustrates the above-described trend. FIG. 23 shows the resistance force determined according to the above-described experiment for three different corners each being 10" long and having wing dimensions 2"×2". The above described experimentation helped to determine that the wing dimensions have a relatively insignificant impact on the resistance force of the corner. It is however noteworthy that, although wing dimensions may not significantly affect the resistance force of the corner, the choice of wing dimensions can greatly influence the overall weight of the corner, and its related cost. For example, it has been determined that for a corner having wing dimensions of 1.5"×1.5" and a wing thickness of about 200 points, the resistance force is about 400 lbs. In a corner having dimensions of 2"×2", this same resistance force can be obtained with a wing thickness of about 180 points. Thus, although the 2"×2" corner has thinner wings and procures roughly the same resistance force, it has been determined that it weighs roughly 10% more than the 1.5"×1.5" corner, and thus is more expensive to manufacture.

In light of these findings, it has been determined that for corners having wing thicknesses up to about 150 points, wing dimensions of 1.5"×1.5" can provide the optimal balance between corner weight (and thus cost) and resistance force. For wing thicknesses between 150 points and 170 points, wing dimensions of 2"×2" can provide the optimal balance. For wing thicknesses between 170 points and 180 points, wing dimensions of 2.5"×2.5" can provide the optimal balance. Finally, for wing thicknesses greater than 180 points, wing dimensions of 3"×3" can provide the optimal balance.

The results in FIG. 23 are herein further explained with reference to FIGS. 20A to 20C. The conventional corner represented as number 1 in FIG. 23 and as FIG. 20A, can be a conventional cardboard corner of 100 lbs. delamination resistance and which has a thickness-to-weight ratio between 1.6 and 1.7. The conventional corner can have 160 points wing thickness.

Figures 20A, 20B, 20C:
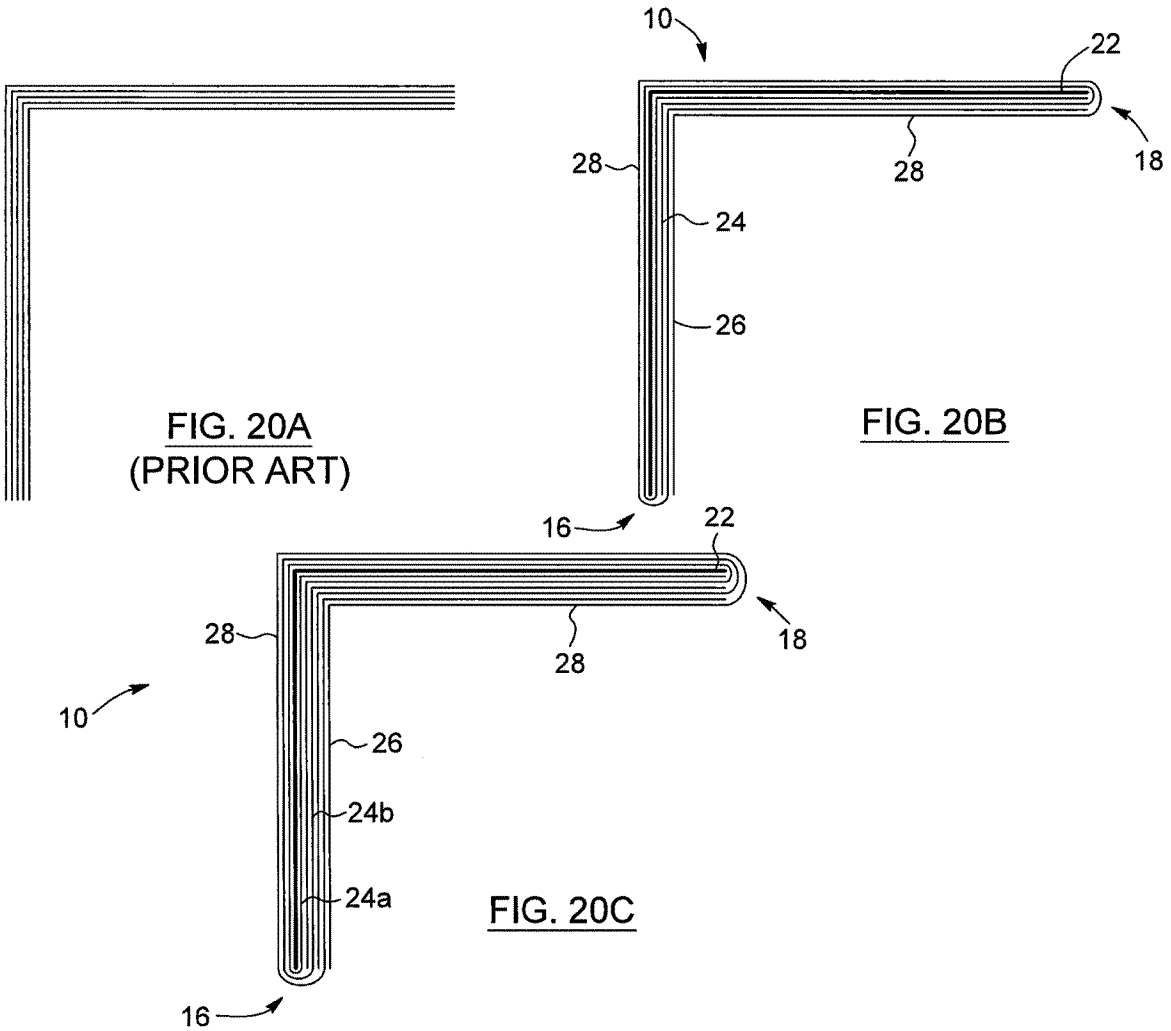
FIG. 20A (PRIOR ART)

The 2-ply corner 10, represented as number 2 in FIG. 23 and as FIG. 20B, consists of an inner ply 22 of 100 points thickness, and two plies 24, 26, each having a thickness of 10 points folded over the inner ply 22, as explained above. The plies 24,26 once folded contribute to 60 pts of the total thickness of the corner 10, the folded plies 24,26 forming a total six stacked ply sections 28 of 10 pts each, on each wing 16,18 of the corner 10. In other words, the folded plies 24,26 are folded over the inner ply 22 such that the total thickness of each wing of the corner 10 remains 160 points, and is thus comparable to the conventional corner illustrated in FIG. 20A.

The 3-ply corner 10, represented as number 3 in FIG. 23 and as FIG. 20C, consists of an inner ply 22 of 70 points thickness and three plies 24*a*,24*b*,26, each having a thickness of 10 points folded over the inner ply 22, as explained above. The plies 24*a*,24*b*,26 once folded contribute 90 points to the total thickness of each wing 16,18 of the corner 10, the folded plies 24*a*,24*b*,26 forming in total nine ply sections 28 of 10 pts each, on each wing 16,18 of the corner 10. The folded plies 24*a*,24*b*,26 are folded over the inner ply 22 such that the total thickness of each wing 16,18 of the corner remains 160 points, and is thus also comparable to the conventional corner of FIG. 20A, and to the 2-ply corner illustrated in FIG. 20B.

The results establish that the 2-ply and 3-ply corners according to the present invention have considerably more resistance force. Furthermore, the results suggest that increasing the number of plies can increase the resistance force exponentially rather than simply linearly.

The ability to increase the resistance force while maintaining low thickness is even more advantageous because it reduces material and manufacturing costs when compared to the corners known in the art. The cost of such thin paper is considerably lower than the type of paper currently used to manufacture conventional paperboard corners. One such example of a different, more expensive, material used in corners is described in U.S. Pat. No. 7,299,924 B2, which describes the use of corrugated cardboard in its corners. Manufacturers of conventional cardboard corners do not often consider using the non-corrugated paperboard as described herein for making their corners because using it with known techniques cannot provide adequate rigidity and resistance force. By using two or more plies folded as described above, this inexpensive, thin paperboard can be used, providing the double advantage of lowering the costs of the corners while increasing its rigidity and resistance.

In some embodiments of the corners 10, more adhesive is used than for conventional corners, in the order of 4% to 6% more, since a greater number of thin-paper layers are used. This provides the advantage of providing more structural capabilities to the corners when they are manufactured. The costs of corners is still kept low as it is the cost of the paperboard that contributes most to the overall costs of the corners.

By reducing the thickness of the plies used to manufacture the corners, the overall weight of the corners can also be reduced, and so too the manufacturing costs. The width of the wings of the corners can be lowered compared to prior art corners, in the order of 15 to 50%.

The corner 10 also presents ancillary benefits such as being environmentally friendly because it can be manufactured from recycled or re-used paperboard products which would otherwise be deposited as landfill.

The folded plies allow thinner, and thus cheaper, plies to be used. By folding at least some of the plies, the corner becomes more rigid and better able to resist impact and shear stresses, as well as tearing. A thinner corner is easier to produce, and because it is lighter than a thicker corner, easier and cheaper to transport.

Furthermore, the ability to combine plies of different thickness and composition in the same corner increases the variety of protective devices available, thus increasing market choice. Therefore, a client can choose a particular corner for a particular purpose. Similarly, the modularity of the corner according to the present invention, meaning that different plies can be added or removed easily, results in a more versatile corner.

Of course, numerous modifications could be made to the above-described embodiments without departing from the scope of the invention, as apparent to a person skilled in the art.

The invention claimed is:

1. A protective paperboard corner for applying against a portion of a product during transport or packaging so as to protect the portion of the product, the corner comprising:

an inner paperboard core having first and second inner wings intersecting substantially perpendicularly at an inner apex, at least three non-corrugated paperboard plies superimposed to form an overlapped ply, the overlapped ply being folded about said inner paperboard core into a plurality of sections, a section being defined by two consecutive folds or by a fold and an end of the overlapped ply;

the first and second wings having a thickness in the range of about 100 to about 250 points; and each ply being made from a paperboard having a grammage of about 120 to about 380 g/m$^2$;

the overlapped ply comprising first, second, third, fourth, fifth, and sixth sections; and wherein the first and second sections are folded so as to intersect substantially perpendicularly on an inner or outer side of the corner, the second and third sections are folded so as to form part of the first wing, the third and fourth sections are folded so as to intersect substantially perpendicularly, the fourth and fifth sections are folded to form the second wing, and the fifth and sixth sections facing the first and second sections, respectively, the sixth section forming part of the first wing.

2. A protective paperboard corner according to claim 1, wherein the at least three non-corrugated paperboard plies are adhered together.

3. A protective paperboard corner according to claim 1, wherein the fifth and sixth sections completely overlap the first and second sections, respectively.

4. A protective paperboard corner according to claim 1, wherein the inner core comprises a plurality of inner layers, each layer adhered to another to create the inner core.

5. A protective paperboard corner according to claim 4, wherein each of the inner layers has a thickness between about 4 and about 60 points.

6. A protective paperboard corner according to claim 5, wherein the inner core comprises between 2 and about 5 inner layers.

7. A protective paperboard corner according to claim 1, wherein the inner core comprises a single inner layer.

8. A protective paperboard corner according to claim 7, wherein the single inner layer has a thickness of at least about 8 points.

9. A protective paperboard corner according to claim 8, wherein the single inner layer has a thickness of between about 25 and about 30 points.

10. A protective paperboard corner according to claim 1, wherein any one of the at least three plies has a thickness between about 4 and about 20 points.

11. A protective paperboard corner according to claim 1, wherein the fifth and sixth sections are on an inner side of the corner.

12. A protective paperboard corner according to claim 1, wherein the first and the fifth sections completely overlap one another for one of the wings, and the second and the sixth sections only partially overlap for the other one of the wings.

13. A protective paperboard corner according to claim 1, wherein the thickness of the first and second wings is about 120 to about 190 points and the corresponding resistance force of the apex is about 100 to about 300 lbs.

14. A protective paperboard corner according to claim 1, wherein the at least three non-corrugated paperboard plies are adhered together using an adhesive selected from the group consisting of polyvinyl alcohol, polyvinyl acetate, dextrin, and acrylic.

15. A protective paperboard corner according to claim 1, wherein the paperboard is selected from the group consisting of liner cardboard, medium cardboard, kraft cardboard, and gypsum board.

16. A protective paperboard corner according to claim 1, wherein the apex has a resistance force of about 100 lbs to about 500 lbs, the resistance force being measurable by mounting the corner upon two blocks, both blocks being about 1.5 inches wide and separated by about 10 inches, and a force being applied to the apex at a middle of the corner until a fracture is detected, the resistance force being the force at which the corner fractures.

17. An in-line method for creating a protective paperboard corner for applying against a portion of a product during transport or packaging so as to protect the portion of the product, the method comprising the steps of:

providing an inner paperboard core;

providing at least three non-corrugated paperboard plies, each ply being made from a paperboard having a grammage of about 120 to about 380 g/m$^2$;

superimposing the at least two plies to form an overlapped ply;

folding the overlapped ply into a plurality of sections around said inner paperboard core, to create first and second wings intersecting substantially perpendicularly at an apex, a section being defined by two consecutive folds or by a fold line and an end of the overlapped ply;

the first and second wings having a thickness of about 100 to about 250 points;

wherein the overlapped ply comprises first, second, third, fourth, fifth, and sixth sections; and wherein the first and second sections are folded so as to intersect substantially perpendicularly so as to form an inner or outer portion of the corner, the second and third sections are folded so as to form part of the first wing, the third and fourth sections are folded so as to intersect substantially perpendicularly, the fourth and fifth sections are folded to form the second wing, and the fifth and sixth sections facing the first and second sections, respectively, the sixth section forming part of the first wing.

18. The method according to claim 17, wherein the at least two plies are combined with an application of adhesive.

19. The method according to claim 17, wherein the inner paperboard core is made by folding a plurality of inner layers, each layer adhered to another to create the inner core.

20. The method according to claim 17, wherein in at least one of the first and second wings, the second and the sixth sections completely overlap one another, and the first and the fifth sections only partially overlap.

* * * * *